US005906729A

United States Patent [19]

Chou

[11] Patent Number: 5,906,729

[45] Date of Patent: May 25, 1999

[54] PROCESS SCHEME FOR PROCESSING SOUR FEED IN ISOMERIZATION DEWAXING

[75] Inventor: Tai-Sheng Chou, Cherry Hill, N.J.

[73] Assignee: Mobil Oil Corporation, Fairfax, Va.

[21] Appl. No.: 08/986,781

[22] Filed: Dec. 8, 1997

[51] Int. Cl.[6] ..... C10G 69/02

[52] U.S. Cl. ..... 208/89; 208/27; 208/61

[58] Field of Search ..... 208/27, 89, 61

[56] References Cited

U.S. PATENT DOCUMENTS

| | | | |
|---|---|---|---|
| 3,915,841 | 10/1975 | Murphy, Jr. et al. | 208/89 |
| 4,764,266 | 8/1988 | Chen et al. | 208/58 |
| 4,851,109 | 7/1989 | Chen et al. | 208/58 |
| 4,913,797 | 4/1990 | Albinson et al. | 208/89 |

*Primary Examiner*—Walter D. Griffin

*Attorney, Agent, or Firm*—Penny L. Prater; Malcolm D. Keen

[57] ABSTRACT

This invention is directed to an improved process scheme to process sour feed in the reaction section of the process unit, including isomerization dewaxing with zeolite beta. The instant invention employs countercurrent flow in the fixed bed of the MIDW(Mobil Isomerization Dewaxing) reactor (the reactor in which isomerization dewaxing occurs) with recycle gas being the gas stream in the MIDW bed. With this arrangement hydrodesulfurization(HDS) and MIDW occur in an integrated process.

10 Claims, 4 Drawing Sheets

PROCESS SCHEME FOR PROCESSING SOUR FEED IN ISOMERIZATION DEWAXING

FIELD OF THE INVENTION

This invention is directed to an improved process scheme to process sour feed in the reaction section of the process unit, including isomerization dewaxing with zeolite beta. The instant invention employs countercurrent flow in the fixed bed of the MIDW(Mobil Isomerization Dewaxing) reactor (the reactor in which isomerization dewaxing occurs) with recycle gas being the gas stream in the MIDW bed. With this arrangement hydrodesulfurization(HDS) and MIDW occur in an integrated process.

BACKGROUND

MIDW employs Pt/ zeolite beta at low pressure (about 400 psi), preferably in the absence of sulfur contamination, although trace amounts of sulfur may be permitted, to drive dehydrogenation and isomerization reactions. The products are low pour point kerosene, diesel, and fuel oil products. A hydrogen partial pressure greater than 400 psi in an MIDW bed may actually reduce the dehydrogenation function of MIDW. For this reason, the preferred feed to commercial MIDW installations is the hydrotreated effluent of the Moderate Pressure Hydrocracking Process (MPHC). This is a clean feed, having a low heteroatom content. The instant invention provides a means for sour feed to be introduced directly into the MIDW process.

Many opportunities exist in refineries not employing MIDW to produce low pour point products in order to reduce the amount of valuable cutter stock required to satisfy the fuel oil pour point specifications. These refineries have fuel oils with high sulfur content, which render the MIDW process inoperable, due to the poisoning of the Pt metal which is required for the dehydrogenation reactions of MIDW by the sulfur compounds or $H_2S$. (The partial denitrogenation reactions for the fuel oil in the HDS beds also produce $NH_3$ byproducts, which reduce the acid isomerization function of the zeolite, if the HDS effluent is cascaded to the MIDW bed without proper stripping of $NH_3$.)

There have been previous examples of counter-current mode operation in a commercial hydroprocessing unit. Criterion/Lummus disclosed the SynSat process in the *Oil and Gas Journal*, Jul. 1,1991, p.55. This process involves the integration of hydrodesulfurization and aromatic saturation. The aromatic saturation bed requires a higher purity make-up gas in the bottom of the aromatic saturation bed (than is required in the MIDW bed of the instant invention) because of the need for high hydrogen consumption in the aromatic saturation step.

U.S. Pat. No. 4,764,266 and U.S. Pat. No. 4,851,109 disclose the MIDW process as it is often practiced. Feed is subjected to the Moderate Pressure Hydrocracking step and some materials in the kerosene and distillate boiling ranges are removed before the unconverted paraffinic residue of MPHC effluent is subjected to MIDW. MPHC effluent is a clean feed of low heteroatom content. A hydrofinishing step follows MIDW. There is no teaching of the use of recycle gas in the MIDW step, or of the use of catalytic hydrodesulfurization (CHD) prior to MIDW. U.S. Pat. No. 4,851,109, which is based on a continuation application of U.S. Pat. No. 4,764,266, contains an additional solvent extraction step following MIDW before the lube is subjected to hydrofinishing.

Although MPHC effluent (which is a clean feed) is the preferred source of feed to the MIDW process, fuel oils produced by methods other than MPHC are at times available for use. These may have a high heteroatom content. Consequently, stripping of $H_2S$ and $NH_3$ is required at two separate points, following the hydrocracking stage, and following the MIDW reaction section.

A significant difference in the process parameters exists for HDF(HDS or CHD) and MIDW, which impacts on the capital investment. Consequently, the equipment requirements include separate heating and cooling for the feed and the effluent, separate high pressure separators, and separate recycle compressors to accommodate the requirements for the two stages. Basic design parameters for the two reaction sections are described as follows:

TABLE 1

| | HDS | MIDW |
|---|---|---|
| Temperature, F. | 650–750 | 600–750 |
| Hydrogen partial pressure, psi | 600–800 | 400 |
| Hydrogen consumption, SCF/B | 300 | 200 |
| Hydrogen circulation, SCF/B | 1200 | 2000 |
| Impact of $H_2S$ on inhibition of catalyst | Minor | Significant |

SUMMARY

Figure 1:
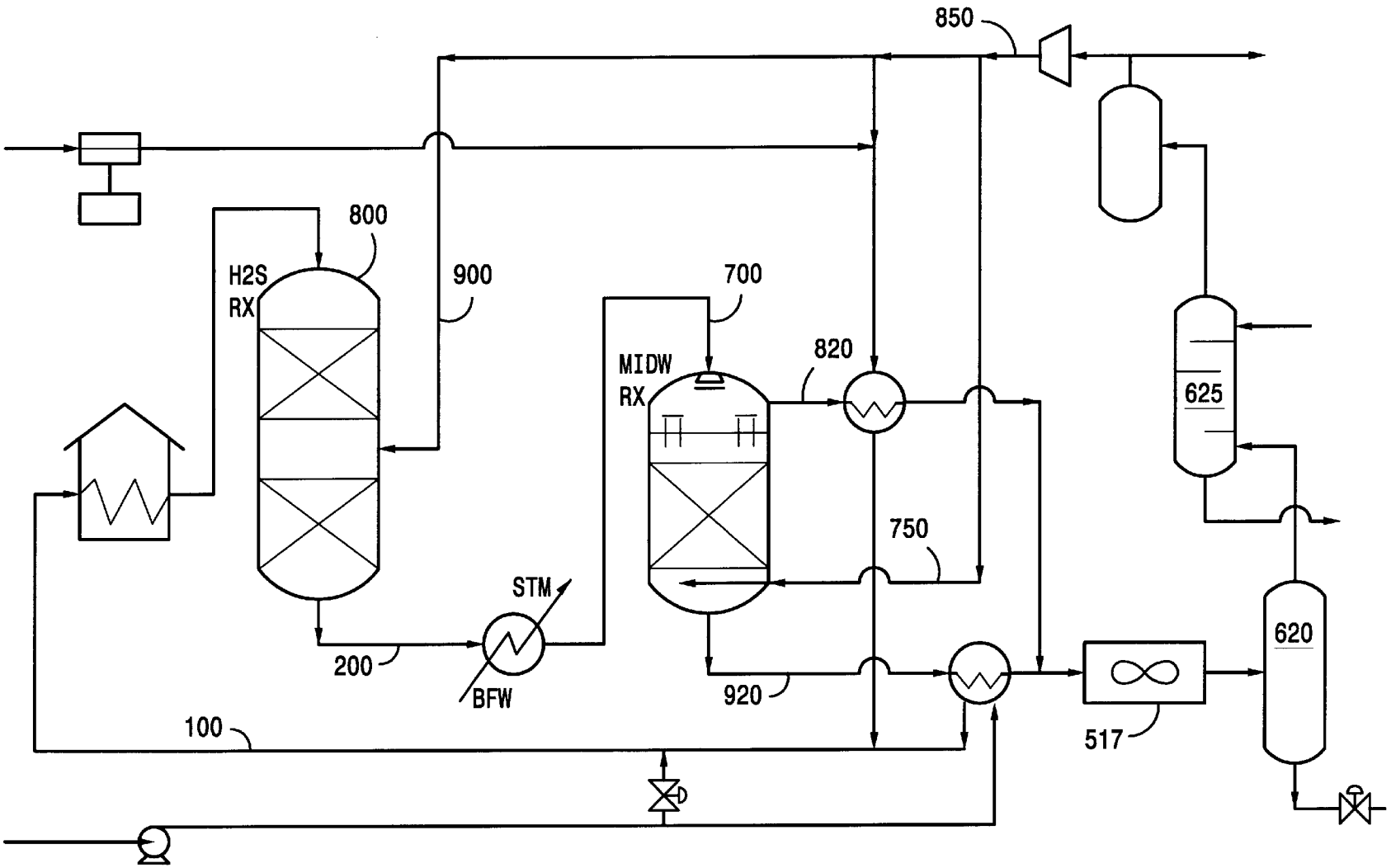
FIG. 1 illustrates the flow chart for an integrated HDS/MIDW process.

An improved process scheme (see FIG. 1) has been developed to employ hydrodesulfurization(HDS) or catalytic hydrodesulfurization (CHD) in synergistic combination with MIDW. No interstage separation is necessary.

The process of the instant invention places the MIDW bed or beds immediately after the conventional HDS beds in a counter-current mode operation to strip $H_2S$ and $NH_3$ in the HDS reactor effluent to prevent sulfur poisoning for the Pt containing MIDW catalyst and to maintain the strength of the zeolite for the isomerization function. The gas stream used in the bottom of the MIDW bed is the recycle gas from the discharge of the recycle compressor. (A high pressure amine absorber is included in the recycle gas loop to remove $H_2S$ and $NH_3$ in the recycle gas stream.)

The disclosed process scheme can satisfy the hydrogen partial pressure requirement in the HDS and MIDW beds, while operating in the comparable reactor total pressure range. The makeup hydrogen for both HDS and MIDW is in the range of from 400–600 SCF/B, preferably about 500 SCF/B is introduced at the inlet of the HDS reactor to maximize (or match) the required hydrogen partial pressure. Normal hydroprocessing units with limited availability of make-up hydrogen in the refinery (or at a minimal high pressure purge rate) shows much lower hydrogen purity for the recycle gas, compared to the make-up hydrogen purity. As an example, a make-up hydrogen purity of 85–90% obtained from the catalytic reformer often results in 50 to 70% purity hydrogen for the recycle gas, depending upon the purge gas rate. Consequently, the inclusion of the MIDW make-up portion in the HDS reactor inlet can reduce the impact of the hydrogen purity dilution contributed by the recycle gas while satisfying the recycle hydrogen requirement for the HDS reactor. The use of the recycle gas with lower hydrogen purity in the bottom of the MIDW bed can satisfy the requirement of about 400 psi hydrogen partial pressure while operating at a much high reactor pressure. Thus, the operation of the HDS and MIDW integrated process becomes compatible using the same cooling and preheat apparatus for the feed and effluent, a common high pressure separator and a common recycle compressor.

DETAILED DESCRIPTION OF THE INVENTION

Feed

The feeds to the instant invention are distillates possessing a high sulfur content. Kerosene, straight run gas oils and coker light gas oil (CLGO) and mixtures of feed such as these are also appropriate. Often they are produced by fluid catalytic cracking or thermal cracking operations. Hydrocracking processes such as MPHC would produce clean feeds with low heteroatom content, so they are not used in this invention. The feeds of this invention have initial boiling points between about 160° C. and 250° C., with endpoints up to about 375° C. Light distillate boils between about 176° C. and 343° C. while heavy distillate boils above about 342° C. Distillate fuel oils may possess endpoints up to 455° C. and are quite aromatic in character. Prior to dewaxing, suitable feeds have pour points within the range of about −25° C. to+5° C. The waxy distillate can be dewaxed employing the MIDW process under conditions as described below, to produce dewaxed distillate with a pour point below −5° C., preferably below −15° C.

Catalysts

In the hydrodesulfurization bed a Co–Mo on alumina or other conventional hydrodesulfurization catalyst is employed. Conventional catalytic hydrodesulfurization (CHD) is a well known process for reducing the sulfur content of a virgin kerosene or other distillate of otherwise suitable quality to bring such a feed into conformance with the sulfur specification for jet fuel, diesels, and fuel oils. Typical CHD catalysts contain from about 2 to about 4 wt % cobalt and about 8 to about 10.5 wt % molybdenum on an alumina support. There are a number of commercially available catalysts which differ in the nature of the support, amount of metal, etc., and also a number of known process variations.

In the MIDW bed a hydrocracking or hydroisomerization step occurs using a catalyst combining acidic functionality based on zeolite beta and hydrogenation functionality. The hydrogenation functionality may be provided either by a base metal or a noble metal as described above, for example, by nickel, tungsten, cobalt, molybdenum, palladium, platinum or combinations of such metals, for example, nickel-tungsten, nickel-cobalt or cobalt-molybdenum. The acidic functionality is provided by zeolite beta which is a known zeolite and is described in U.S. Pat. No. RE 28,341, to which reference is made for a description of this zeolite, its preparation and properties. Hydroprocessing catalysts based on zeolite beta are described in U.S. Pat. Nos. 4,419,220, 4,501,926 and 4,518,485, to which reference is made for a description of zeolite beta hydroprocessing catalysts which may be used in the MIDW bed of this process. As described in those patents, the preferred forms of zeolite beta for use in MIDW are the high silica forms, having a silica:alumina ratio of at least 30:1 (structural). Silica:alumina ratios of at least 50:1 and preferably at least 100:1 or over 100:1 or even higher, e.g. 250:1, 500:1 may be used in order to maximize the paraffin isomerization reactions at the expense of cracking. Thus, use of appropriate silica:alumina ratios in the catalyst may, together with controls of catalyst acidity, as measured typically by alpha value, and control of reaction conditions may therefore be employed to vary the nature of the product, particularly the conversion and accordingly the quantity of the converted fraction from the second stage of the process.

Methods for making highly siliceous forms of zeolite beta are described in EU 95,304 to which reference is made for a description of them. The silica:alumina ratios referred to in this specification are the structural or framework ratios as mentioned in EU 95,304.

DESCRIPTION OF THE PREFERRED EMBODIMENT

FIG. 1 illustrates the preferred embodiment (schematic) of the instant invention. Hydrocarbon feed is pumped through a series of exchangers, then combined with makeup hydrogen. The combination of feed and hydrogen is heated (line 100) prior to entering hydrodesulfurization reactor bed 800, in order to reach the appropriate reaction temperature. Hydrogen (line 900) may also be used as an interbed quench. The effluent of reactor 800 is cooled, if necessary (line 200) prior to entering the MIDW reactor bed 700 at the top of the reactor. Hydrogen (line 950) enters at the base of the reactor 700 and flows upward, mixing countercurrently with the feed in the reactor bed. The MIDW effluent (line 920) is cooled, then mixed (mixer 500) with the hydrogen exiting the MIDW reactor (line 820) before entering high pressure separator 620. The MIDW product exits the separator drum at the base. The hydrogen gas exits the top of separator 620 and passes through amine absorber 625 to remove $H_2S$ and $NH_3$ prior to being recycled via line 850.

Data

Table 2 provides the feed properties of the base feed used to demonstrate the effectiveness of countercurrent MIDW, prior to hydrotreating of the feed to remove heteroatoms. The base feed is a 50/50 vol/vol mixture of an atmospheric gas oil and a vacuum gas oil. Table 3 provides data necessary for determining the activity and selectivity of the MIDW catalyst when contacted with the base feed and with the base feed contaminated by different poisons. The feeds of Table 3 have all been hydrotreated, although poisons were in some cases added subsequently.

The base feed represents a countercurrent MIDW operation which will significantly reduce the $NH_3$ and $H_2S$ present in the recycle gas as compared to a standard downflow reactor. The feeds injected with $H_2S$ and $NH_3$ reflect a typical downflow reactor and show the negative effects of catalyst poisoning.

Figure 2:
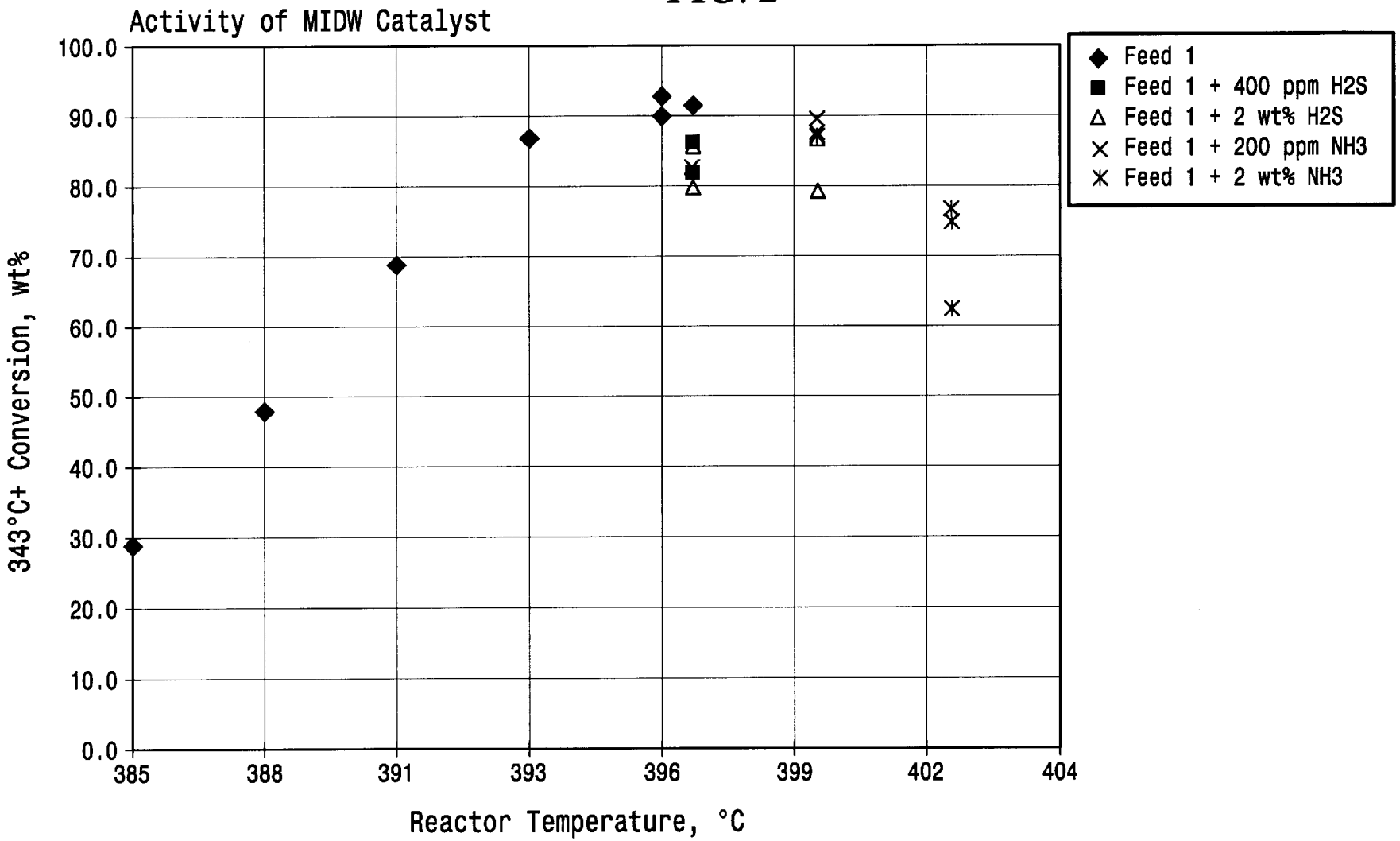
FIG. 2 illustrates the relative effects of feed poisons on MIDW catalyst conversion activity as a function of reactor temperature for feeds containing different poisons.
Figure 3A:
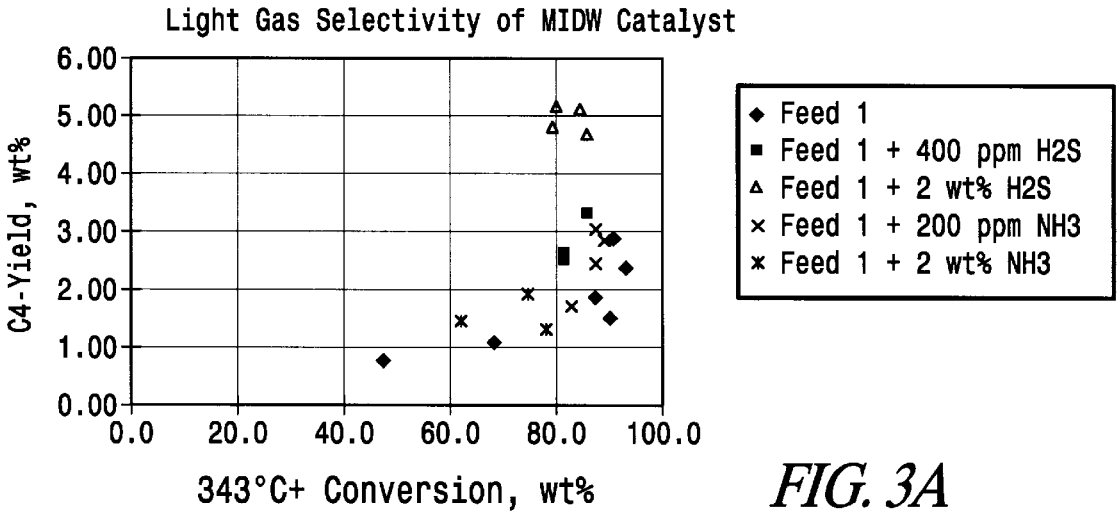
FIGS. 3(*a*)–(*d*) illustrate the relative effects of feed poisons on MIDW catalyst selectivity for light gas production, naphtha production, distillate production and dewaxing effectiveness respectively.
Figure 3B:
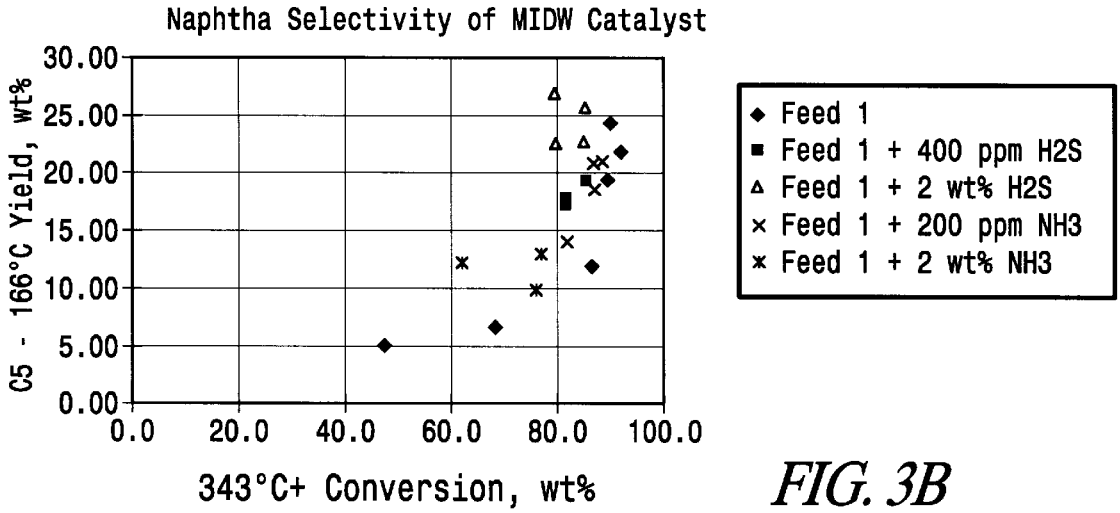
Figure 3C:
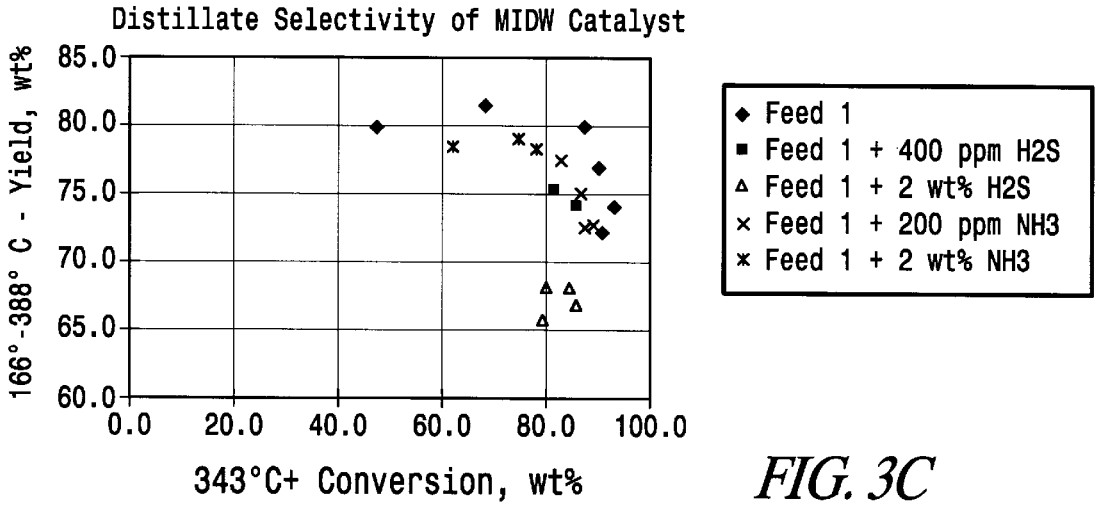
Figure 3D:
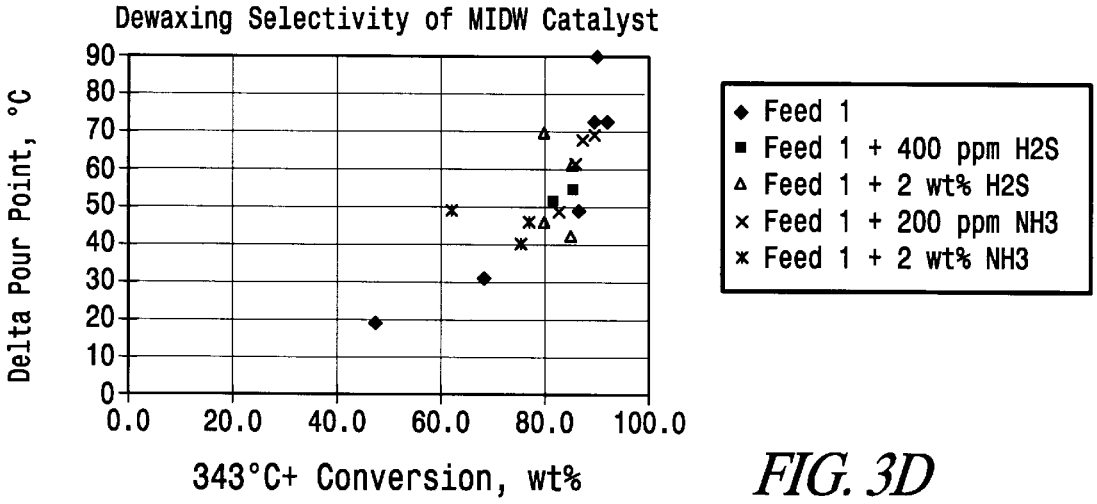

FIG. 2 illustrates that an MIDW catalyst contacting an unpoisoned feed (Feed 1, the hydrotreated base case, which represents countercurrent flow)) possesses high conversion activity at relatively low reactor temperatures (between 725 and 746 F). Little conversion of poisoned feeds occurs at temperatures below 746F. The greater the amount of poison in the feed, the higher the reactor temperature necessary to effect conversion. Therefore a countercurrent flow process can operate at lower temperatures and obtain greater conversion than can a standard downflow MIDW process.

FIGS. 3(*a*)–(*d*) illustrate the relative effects of feed poisons on MIDW catalyst selectivity for light gas production, naphtha production, distillate production and dewaxing effectiveness respectively. MIDW reactors are intended to produce fuels in the distillate boiling range (330–730 F). Countercurrent flow maximizes distillate production. Poisoning gases decrease distillate yield and have negative effects on dewaxing effectiveness. Light gas and naphtha production are increased. These same effects occur in a standard downflow reactor.

TABLE 2

Base Feed Properties Prior to Hydrotreating

| | FEED 1 | |
|---|---|---|
| | Run 1 | Run 2 |
| API | 41.51 | 39.9 |
| Cetane Number | 85.2 | 85.9 |
| Pour Point, F. | 91 | 86 |
| Cloud Point, F. | 115 | 90 |
| Freeze Point, F. | 95 | |
| Flash Point, F. | 316 | 320 |
| Hydrogen, wt % | 14.41 | 14.27 |
| Aromatics, wt % | 19.4 | 20.2 |
| Sulfur, ppm | 249 | 252 |

TABLE 2-continued

Base Feed Properties Prior to Hydrotreating

| | FEED 1 | |
|---|---|---|
| | Run 1 | Run 2 |
| Nitrogen, ppm | 57 | 54 |
| Basic Nitrogen, ppm | | |
| Kinematic Viscosity @ 40 C., cS | 6.468 | 6.418 |
| Kinematic Viscosity @ 130 F., cS | 3.933 | |
| Kinematic Viscosity @ 100 C., cS | 2.113 | 2.176 |
| ASTM Color | <1.5 | |
| Distillation | | |
| IBP | 391 | 417 |
| 10 | 550 | 542 |
| 30 | 626 | 618 |
| 50 | 667 | 660 |
| 70 | 702 | 696 |
| 90 | 775 | 769 |
| EP | 909 | 905 |

TABLE 3(a)

Hydrotreated Base Feed (Feed 1) Data

| | Run 1 | Run 2 | Run 3 | Run 4 | Run 5 | Run 6 | Run 7 | Run 8 |
|---|---|---|---|---|---|---|---|---|
| Reactor Temperature ° F. | 725 | 730 | 735 | 740 | 745 | 745 | 746 | 746 |
| Conv. (650+), wt. % | 28.7 | 47.8 | 68.9 | 87.0 | 89.8 | 92.7 | 91.3 | 75.7 |
| $C_4$-Yield wt. % | 1.78 | 0.78 | 1.13 | 1.83 | 1.51 | 2.34 | 2.92 | 3.97 |
| $C_5$-330° F. Yield, wt. % | 3.51 | 4.94 | 6.63 | 11.90 | 19.16 | 21.96 | 24.04 | 23.59 |
| 330–730° F. Yield, wt. % | 77.90 | 79.41 | 81.42 | 80.04 | 77.00 | 73.99 | 72.03 | 71.10 |
| Delta Pour Point ° C. | 13 | 19 | 31 | 49 | 73 | 73 | 90 | 85 |

TABLE 3(b)

Feed 1 + 400 ppm $H_2S$

| | Run 1 | Run 2 |
|---|---|---|
| Reactor Temperature ° F. | 746 | 746 |
| Conv. (650+), wt. % | 81.9 | 85.6 |
| $C_4$-Yield wt. % | 2.61 | 3.25 |
| $C_5$-330° F. Yield, wt. % | 17.17 | 19.24 |
| 330–730° F. Yield, wt. % | 75.45 | 74.09 |
| Delta Pour Point ° C. | 52 | 55 |

TABLE 3(c)

Feed 1 + 2 Wt. % $H_2S$

| | Run 1 | Run 2 | Run 3 | Run 4 |
|---|---|---|---|---|
| Reactor Temperature ° F. | 751 | 751 | 746 | 746 |
| Conv. (650+), wt. % | 85.9 | 79.4 | 79.7 | 85.2 |
| $C_4$-Yield wt. % | 4.61 | 4.79 | 5.15 | 5.12 |
| $C_5$-330° F. Yield, wt. % | 25.93 | 26.86 | 22.90 | 23.05 |
| 330–730° F. Yield, wt. % | 66.90 | 65.92 | 68.11 | 68.14 |
| Delta Pour Point ° C. | 61 | 70 | 46 | 43 |

TABLE 3(d)

| | Feed 1 + 200 ppm $NH_3$ | | | | | | | | | | |
|---|---|---|---|---|---|---|---|---|---|---|---|
| | Run 1 | Run 2 | Run 3 | Run 4 | Run 5 | Run 6 | Run 7 | Run 8 | Run 9 | Run 10 | Run 11 |
| Reactor Temperature ° F. | 741 | 746 | 746 | 746 | 746 | 746 | 746 | 751 | 751 | 751 | 751 |
| Conv. (650+), wt. % | 86.3 | 75.9 | 76.9 | 75.5 | 64.9 | 71.0 | 82.9 | 86.6 | 87.3 | 89.6 | 68.9 |
| $C_4$-Yield wt. % | 3.35 | 3.34 | 2.47 | 2.43 | 2.41 | 4.53 | 1.74 | 2.45 | 2.97 | 2.85 | 3.41 |
| $C_6$-330° F. Yield, wt. % | 20.83 | 22.41 | 16.72 | 17.14 | 16.24 | 15.45 | 14.85 | 19.41 | 22.01 | 22.20 | 23.62 |
| 330–730° F. Yield, wt. % | 73.19 | 71.84 | 76.22 | 76.06 | 76.52 | 73.08 | 77.61 | 75.01 | 72.73 | 72.85 | 71.36 |

TABLE 3(e)

| | Feed 1 + 2 Wt % $NH_3$ | | |
|---|---|---|---|
| | Run 1 | Run 2 | Run 3 |
| Reactor Temperature ° F. | 756 | 756 | 756 |
| Conv. (650+), wt. % | 75.0 | 76.7 | 62.3 |
| $C_4$-Yield wt. % | 2.23 | 1.68 | 1.75 |
| $C_5$-330° F. Yield, wt. % | 12.45 | 15.17 | 15.12 |
| 330–730° F. Yield, wt. % | 79.04 | 78.18 | 78.38 |

We claim:

1. An integrated hydroprocessing method for upgrading a hydrocarbon feedstock of high sulfur content having an initial boiling point of at least 160C, to produce a distillate product of maximum yield, having a reduced sulfur content and a reduced pour point, which comprises the following steps:

(a) hydrodesulfurizing the hydrocarbon feed over a fixed bed of hydrodesulfurization catalyst having a hydrogenation-dehydrogenation functionality, under hydrodesulfurization conditions at a hydrogen partial pressure of from 400 to 600 psi;

(b) hydroprocessing the effluent of step (a) over a fixed bed of hydroprocessing catalyst comprising zeolite beta as an acidic component, in addition to a hydrogenation-dehydrogenation functionality, wherein makeup hydrogen flows countercurrently to the effluent of step(a) in the fixed bed of hydroprocessing catalyst in order to strip $H_2S$ and $NH_3$ from the effluent of step (a), thereby maintaining the strength of the zeolite beta as an acidic component in addition to preserving the effectiveness of the hydrogenation-dehydrogenation functionality, to produce a distillate boiling range product having an enhanced content of isoparaffinic components and a reduced pour point;

(c) separating the distillate product from lower boiling range materials.

2. The method of claim 1, step (c), wherein the lower boiling range materials, comprising hydrogen, $H_2S$ and $NH_3$, are passed to an amine absorber wherein the hydrogen is separated from the $NH_3$ and $H_2S$ and is recycled to step (b).

3. The method of claim 1, step (a) wherein the hydrodesulfurization catalyst comprises from about 2 to about 4 wt % cobalt and about 8 to about 10.5 wt % molybdenum on an alumina support.

4. The method of claim 1, step (b), wherein hydrogenation-dehydrogenation functionality is provided either by a base metal or a noble metal.

5. The process of claim 4, wherein the base metal is selected from the group consisting of nickel, tungsten, cobalt, or molybdenum.

6. The process of claim 5, wherein the hydrogenation-dehydrogenation functionality is supplied by combinations of base metals.

7. The process of claim 6, wherein the combinations are selected from the group consisting of nickel-tungsten, nickel-cobalt or cobalt-molybdenum.

8. The process of claim 4, wherein the noble metal is selected from the group consisting of Pt or Pd.

9. The process of claim 1, step (b), wherein the zeolite beta possesses a silica: alumina ratio of at least 30:1.

10. The process of claim 9, wherein the zeolite beta possesses a silica: alumina ratio of greater than 500:1.

* * * * *